US005795220A

United States Patent [19]

Core

[11] Patent Number: 5,795,220

[45] Date of Patent: *Aug. 18, 1998

[54] CEILING FAN WITH AN AIR DIFFUSER SYSTEM

[76] Inventor: William Roger Core, 1610 E. 55th Pl., Tulsa, Okla. 74105

[ * ] Notice: This patent issued on a continued prosecution application filed under 37 CFR 1.53(d), and is subject to the twenty year patent term provisions of 35 U.S.C. 154(a)(2).

[21] Appl. No.: 821,096

[22] Filed: Mar. 20, 1997

[51] Int. Cl.[6] ..... F24F 13/06

[52] U.S. Cl. ..... 454/292

[58] Field of Search ..... 454/284, 285, 454/292, 293, 294, 295, 296, 297, 298, 300, 329, 338

[56] References Cited

U.S. PATENT DOCUMENTS

| | | | |
|---|---|---|---|
| Re. 33,347 | 9/1990 | Johnson, III | 454/292 |
| 3,760,708 | 9/1973 | Burup . | |
| 4,589,331 | 5/1986 | Villamagna et al. | 454/239 |
| 4,598,632 | 7/1986 | Johnson, III | 454/292 |
| 5,029,451 | 7/1991 | Imaiida et al. | 62/259.1 |
| 5,097,674 | 3/1992 | Imaiida et al. | 454/292 X |
| 5,564,980 | 10/1996 | Becker | 454/292 X |

FOREIGN PATENT DOCUMENTS

| | | | |
|---|---|---|---|
| 116940 | 5/1943 | Australia | 454/297 |
| 47254 | 3/1937 | France | 454/300 |
| 26 01 557 | 7/1977 | Germany | 454/292 |
| 2 155 170 | 9/1985 | United Kingdom | 454/297 |

*Primary Examiner*—Harold Joyce
*Attorney, Agent, or Firm*—Head, Johnson & Kachigian

[57] ABSTRACT

A system for distributing air in a room, the air being supplied by duct work. A plenum having an open top and an open bottom, the open top being in communication with the duct work. An air diffuser is positioned within the room in communication with the plenum providing passage for air flowing from the plenum into the room. A motor is supported within the diffuser having a downwardly extending motor shaft with a lower portion that extends below the diffuser. A plurality of fan blades extend horizontally from the motor shaft so that as air flows into the room through the diffuser the air is effectively distributed in the room by the action of the rotating fan blades.

11 Claims, 5 Drawing Sheets

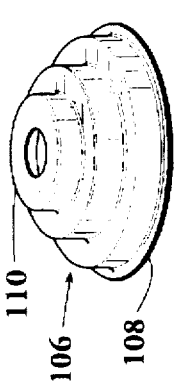
Fig. 8
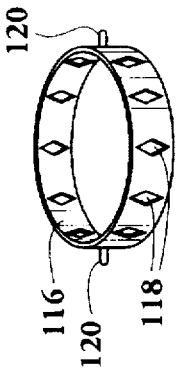
Fig. 10
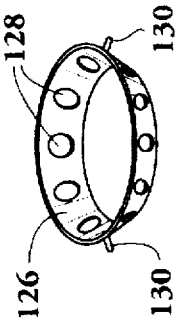
Fig. 11
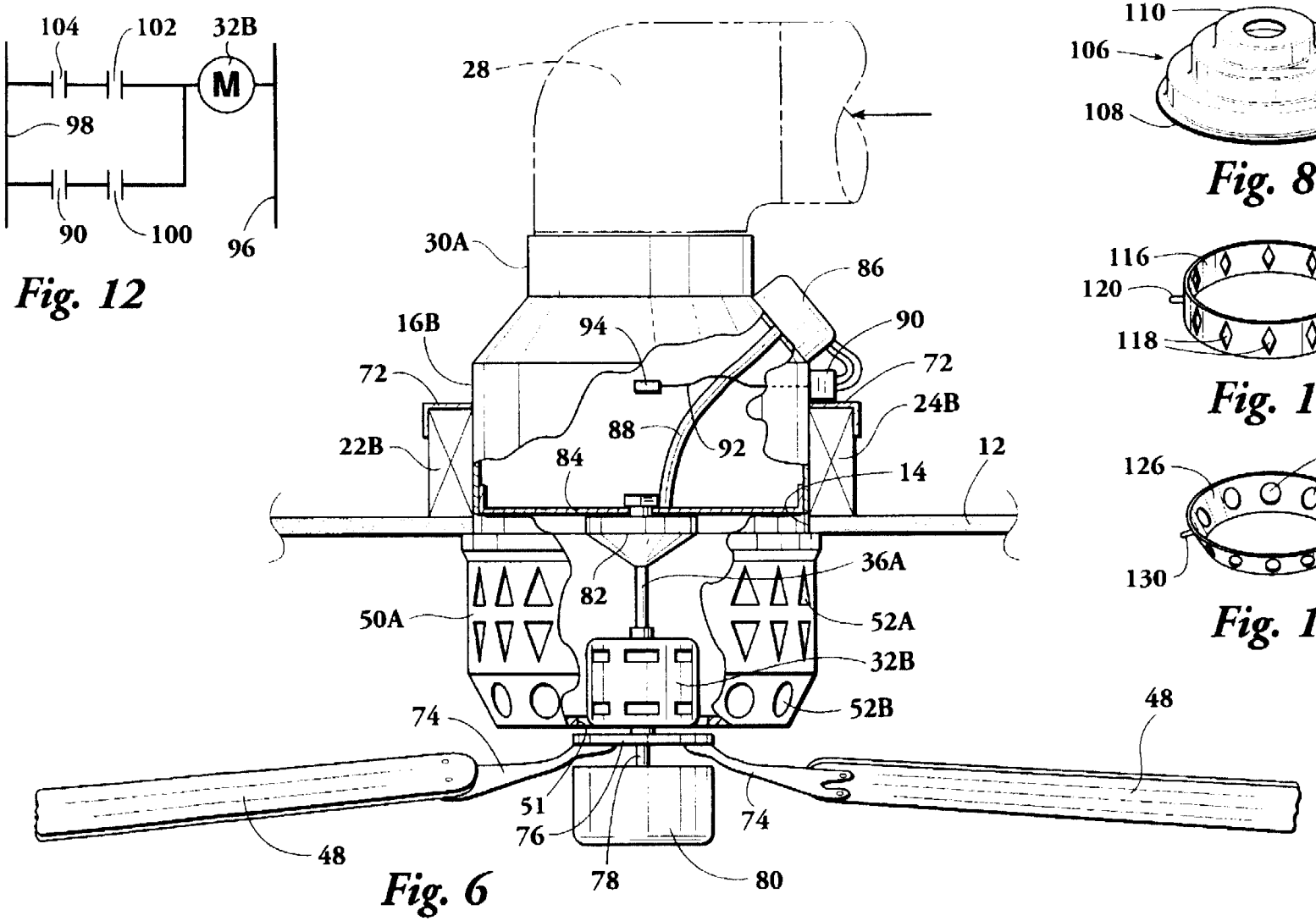
Fig. 6
Fig. 12

*Fig. 7*
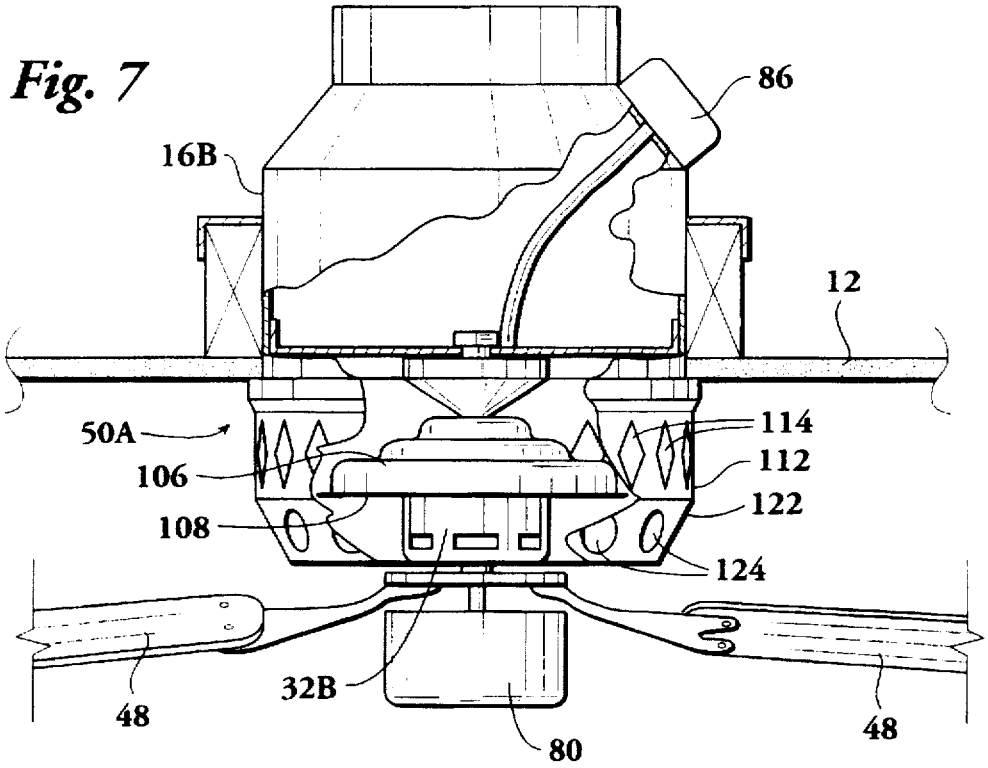
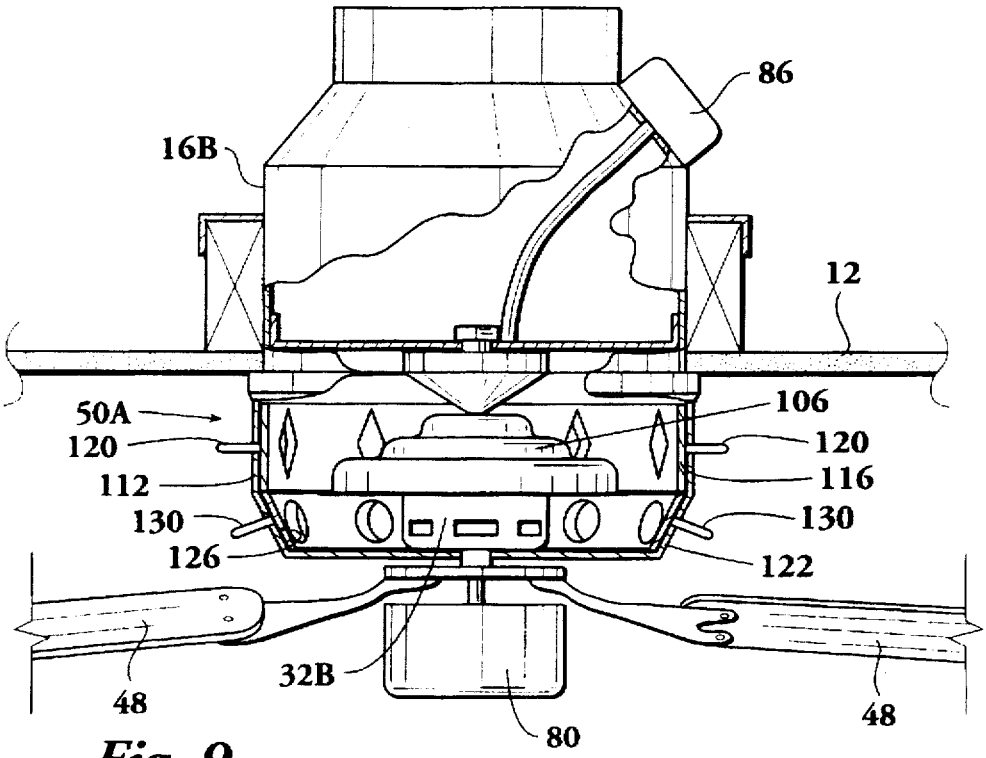
*Fig. 9*

CEILING FAN WITH AN AIR DIFFUSER SYSTEM

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

Heating, ventilation and air conditioning can be broken down into two types of systems, that is, a self contained system and a non-self container system. A self contained system is limited to a specific area, has its own manufactured purchase package components (blower, coil, duct work, inlet, outlet, etc.), and is independent from other sources. Some examples are window air conditioners, unit heaters, wall heaters, roof top package units, room fan powered package units, rest room ventilators, air curtain door fans, etc. A non-self contained system has a central primary air source (air handler or furnace with blower), serves a whole structure or building, is not limited to a specific area, and is made up of various manufactured components.

Most modern heating and/or air conditioning systems used in the world today are non-self contained systems and employ forced air circulation, that is, air is drawn from a room to be heated or cooled, passed through a heating and/or air conditioning system in which the air is heated or cooled and then distributed back through a duct work system to the room to thereby raise or lower the air temperature in the room according to comfort requirements. In some instances air is merely circulated in such system without heating or cooling to improve ventilation. While the air distribution system can be arranged to discharge forced air through the floor, or through a wall of a room, the most common practice is to discharge air, whether for heating, cooling or for ventilation, through the ceiling. A primary reason that discharge of air is made through the ceiling rather than through a floor or wall vent is that most building construction permits ready access to a ceiling compared to a floor or wall.

To distribute air from a forced air system through a ceiling the common practice is to utilize a ceiling vent which typically is designed to not only provide an opening through which air can pass through a ceiling into a room but also to aid in distribution of air in the room. A third desired aspect of a ceiling vent is to provide improved appearance, that is, to provide a way for air to enter a room that is other than simply a hole in the ceiling with which a forced air duct communicates. A covering placed in or over a hole in a ceiling that communicates with a forced air duct is referred to as a "diffuser" or sometimes as an "air register".

Almost since the availability of electrical energy, a way to improve the comfort of a room has been by use of a ceiling fan. Ceiling fans are employed throughout the world and typically consist of a motor having a vertical shaft attached to a hub from which a plurality of blades radially extend. The typical ceiling fan has relatively large blades and the fan is designed to turn the blades at a relatively low rpm so as to achieve good distribution of air in a room without producing excessive noise as is common with a fan that utilizes a small diameter blade rotated at a high rpm.

Ceiling fans are mounted so that the motor is in close proximity to the ceiling with a downwardly extending shaft to which a hub is attached at the lower end. Other ceiling fans employ motors wherein the rotor itself functions also as the hub with blade attachments secured directly to the rotor. Such fans are typically mounted so that the motor is spaced from the ceiling.

Ceiling fans are popular because they have relatively low energy requirements, are effective in air distribution and are quiet. When a room is supplied with an air diffuser for distributing forced air into a room along with a ceiling fan plus the typical light fixtures, a ceiling of a room can become very "busy", that is, cluttered with a number of different items that detract from the appearance of the ceiling. Further, when a ceiling fan is used in a room that also has an air diffuser, and where the air diffuser of the ceiling fan are spaced apart from each other, equal distribution of the forced air from the diffuser is not always effectively achieved.

It is an object of this invention to provide a combination air diffuser and ceiling fan to achieve two basic functions. First, by combining an air diffuser and ceiling fan appearance is enhanced by the decreased number of separate components attached to or extending from the ceiling. Second, and of greater importance, by combining an air diffuser and ceiling fan the effectiveness of distribution of forced air into a room is enhanced.

Others have provided improved means of air distribution combined with ceiling fans and the following previously issued United States patents provide good background information relating to the subject matter of the present invention.

| PAT. NO. | INVENTOR | TITLE |
|---|---|---|
| Re. 33,347 | Johnson III | Air-Driven Ceiling Fan |
| 571,424 | Wolfe | Heating and Ventilating Apparatus For Buildings |
| 1,333,651 | Andrassy | Ventilator |
| 2,038,347 | Cornell, Jr. | Air Conditioned Heating and Cooling System |
| 2,093,936 | Spielmann | Air Conditioning Device |
| 2,239,848 | Jackson | Air Conditioning Apparatus |
| 2,363,839 | Demuth | Unit Type Air Conditioning Register |
| 3,760,708 | Burup | Ventilating System |
| 4,191,506 | Packham | Propeller and Impeller Constructions |
| 4,326,453 | LaBoda et al | Air Transfer Device |
| 4,598,632 | Johnson III | Air-Driven Ceiling Fan |
| 4,779,671 | Dolison | Cooling, Heating and Ventilation System |
| 4,782,213 | Teal | Ceiling Fan Electrically Heating Environmental Air |
| 5,029,451 | Imaiida et al | Air Conditioning Apparatus |
| 5,097,674 | Imaiida et al | Air Conditioning Apparatus |
| 5,462,407 | Calvo | Ceiling Fan Blade and Hub Assembly |

BRIEF SUMMARY OF THE INVENTION

This invention provides a system for distributing air in a room having a ceiling, the ceiling having an opening therethrough. A plenum is mounted above the ceiling, the plenum having an open top and an open bottom. The open bottom is mounted in communication with the ceiling opening and the open top is adapted to receive connection to a source of air under pressure, such as to duct work by which heated, cooled or ventilation air is distributed.

An air diffuser is positioned within the room and in communication with the plenum open bottom. The air diffuser provides for passage of air from the plenum into the room. A fan motor is mounted within the diffuser and has a downwardly extending motor shaft with a lower portion that extends through and below or at least equal to the bottom of the diffuser.

A plurality of fan blades are affixed to and extend radially and horizontally from the motor shaft lower portion.

In some applications of the invention, a shaft is affixed to a motor rotor, the shaft having on the lower end thereof a hub to which the inner ends of blades are attached. In other types of ceiling fans the lower end of the rotor itself functions as a shaft and the inner ends of blades are attached directly to the lower end of the rotor. Under either of these conditions the motor itself is within the diffuser and the motor shaft or the lower end of the rotor is accessible for securing the inner ends of blades to it so that the blades can be rotated in a horizontal plane.

When the invention is utilized on a high ceiling in a room or on a pitched ceiling, a vertically extending tubular sleeve is secured to the plenum lower end, the sleeve extending downwardly to a diffuser in which the ceiling fan motor is housed, the motor being supported by a non-rotating shaft extending from the ceiling. The invention can be utilized on exposed duct work and without a finished ceiling.

To streamline flow of air through a diffuser, and to achieve improved air distribution, a tiered deflector cone may be installed within the diffuser.

The air diffuser may be provided with one or more control dampers that are preferably in the form of circumferential band fittings with a circular diffuser, the bands having openings therein that may be aligned or not aligned with openings in the diffuser to control air flow volume.

The combination ceiling fan/air diffuser of this disclosure may include an air flow switch to cause the ceiling fan to be activated when air is moving through the diffuser. This system is particularly adaptable when the diffuser is a part of a forced air heating and air conditioning system that provides air flow in response to a thermostat.

A better understanding of the invention will be obtained from the following description of the preferred embodiments and the claims, taken in conjunction with the attached drawings.

DESCRIPTION OF THE DRAWINGS

FIG. 6 is an alternate embodiment of the invention showing a type of fan motor wherein the blades are secured directly to the lower end of the fan motor. An air switch is employed in the air flow path to actuate in response to air flow such as provided when the diffuser/ceiling fan unit is a part of an automatic forced air heating and/or air conditioning system.

FIG. 7 is an elevational, partial cross-sectional view of an air diffuser/ceiling fan combination such as shown in FIG. 6 but, in addition, disclosing the use of a deflector cone within the diffuser to improve the flow of air out of the diffuser.

FIG. 8 is an isometric view of the deflector cone as employed in FIG. 7.

FIG. 9 is like FIG. 7 but shows the addition of slip bands within the diffuser that provide damper control of air discharged from the diffuser.

FIG. 10 is an isometric view of a short length tubular shaped slip band that functions as a damper in FIG. 9.

FIG. 11 is an isometric view of a short frusto-conical shaped slip band that is one of the dampers employed in FIG. 9.

FIG. 12 is a simplified electrical circuit showing a way of using an air switch in conjunction with the normal on/off switch for automatically turning the fan on when air is flowing through the plenum.

DETAILED DESCRIPTION OF THE PREFERRED EMBODIMENTS

Figure 2:
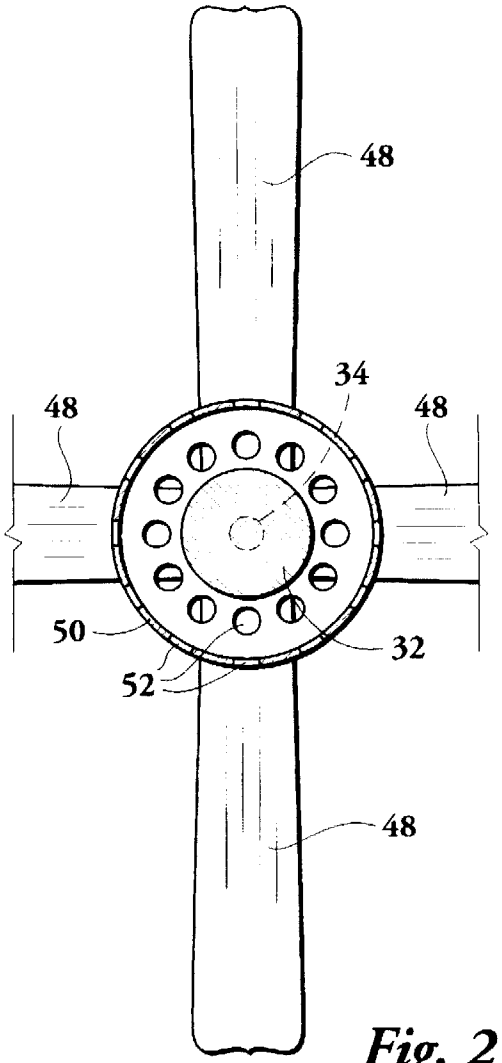
FIG. 2 is a fragmentary horizontal cross-sectional view taken along the line 2—2 showing the relationship between the fan motor and the diffuser.
Figure 1:
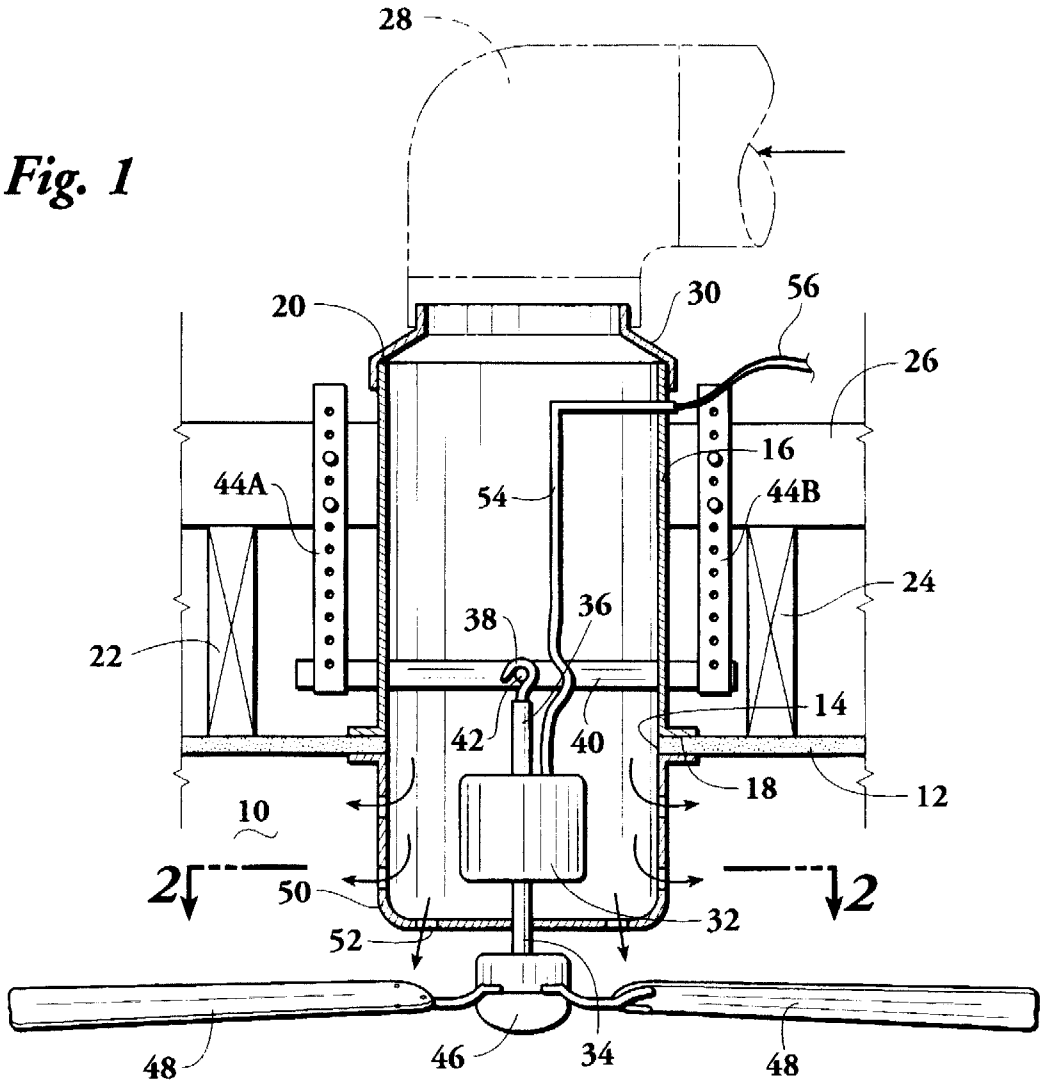
FIG. 1 is an elevational cross-sectional view of one means of employing the system of this invention showing, in cross-section, a ceiling of a room above which a plenum is mounted, the plenum having communication with an opening in the ceiling. Below the ceiling an air diffuser is secured in communication with the ceiling. A fan motor is mounted within the air diffuser. Extending from the fan motor is a shaft connected to a hub from which extends, in a radial pattern, horizontal fan blades. Air is diffused from a forced air system connected to the plenum. Simultaneously, the ceiling fan aids in distribution of the air within the room. Thus, a single unit provides both forced air diffusion and a ceiling fan for esthetic and economic advantages and for better distribution of the forced air entering the room.

Referring to the drawings and first to FIGS. 1 and 2, a first embodiment of the invention is illustrated. FIG. 1 shows a cross-section of a system for practicing the invention and for providing distribution of air into the interior of a room 10 having a ceiling 12, the ceiling having an opening 14 therein. Opening 14 is typical of means by which forced air can be moved into room 10, forced air being, as an example, warm air for heating the room, cool air for cooling the room or ambient air for providing circulation. The typical of forced air heating or air conditioning system includes a plenum 16, which also may be called a "ceiling boot", having a lower end 18 and an open upper end 20, the lower end 18 communicating with opening 14 in ceiling 12.

In modern day construction ceiling 12 is typically supported to spaced apart ceiling joists 22 and 24, usually made of wood, the ceiling 12 being secured to ceiling joist 22 and 24 by a cross member 26.

A forced air duct 28 is positioned above ceiling 12 and connects to plenum 16 by means of an adapter 20 which may be referred to as a "boot cap adapter".

The system described to this point is typical of means of distributing forced air into a room by providing connection between a forced air duct 28 and an opening 14 in a ceiling. In the usual heating and air conditioning system a diffuser or register is secured to ceiling 12 within room 10 to cover the opening 14 for the dual function of making the opening more esthetically acceptable plus improving the distribution of air forced into the room. This invention includes the elements which will now be described. Supported within the air path of opening 14 formed in ceiling 12 is a fan motor 32 having a shaft 34 extending vertically downwardly therefrom. A motor mount 36 extends upwardly from motor 32 to a hook 38. A hanger bar 40 has a pin 42 that is received by hook 38. The outer ends of hanger bar 40 are secured to the lower ends of straps 44A and 44B that are attached to cross member 26.

Secured to the lower end of shaft 34 is a hub 46 and extending from the hub are a plurality of fan blades 48. FIG. 2 shows that the fan has four blades which is typical although the number of blades can vary, usually from 3 to 6. Blades 48 are relatively large, being typically two to three feet in length, and are sometimes referred to as "paddles". The advantage of the large blades is that effective air distribution can be obtained even though the blades are rotated at a relatively low rpm to thereby move relatively large quantities of air at minimum noise.

Secured to the bottom of ceiling 12 and surrounding motor 32 is a diffuser 50, which may also be referred to as a "grille". Diffuser 50 may be made of thin metal or plastic and has a plurality of openings 52, some of the opening being the sidewall and others, optionally, in the bottom of the diffuser.

A conduit 54 containing wires 56 to provide means of conveying electrical energy to motor 32, it being understood that the specific means of passing electrical energy carrying wires 56 through plenum 16 and for connection to motor 32 is not a part of this invention and can vary considerably depending upon the electrical code of the location where the system is employed.

The system illustrated in FIGS. 1 and 2 has several advantages over forced air distribution systems in use today. First, by providing a diffuser 50 having means of connecting forced air to it along with an integral ceiling fan combines two functions into one unit, thereby reducing ceiling clutter. Second, this arrangement affords an opportunity for reducing expenses of installing both a forced air system diffuser and a ceiling fan in a room. Third, and of equal or greater importance, is the advantage of providing improved distribution of air forced into room 10 from the air heating and/or air conditioning system. By locating diffuser 50 centrally above fan blades 48, air passing into room 10 is very effectively, quickly and equally distributed. Since diffuser 50 is centrally positioned with respect to the fan, air passing into the room through the diffuser is equally distributed throughout the room by rotating blades 48.

Another significant advantage of the system of FIG. 2 is the placement of fan motor 32 within the confines of diffuser 50. Such arrangement enables the diffuser to function as the esthetic covering for the fan motor 32, effectively cools the fan motor by passing by the diffusion of air from the forced air system past the motor and reduces height requirements as compared to a system that places an air diffuser and a ceiling fan motor in a serial relationship, that is, compared to a system wherein a ceiling fan motor is positioned below a diffuser.

Figure 3:
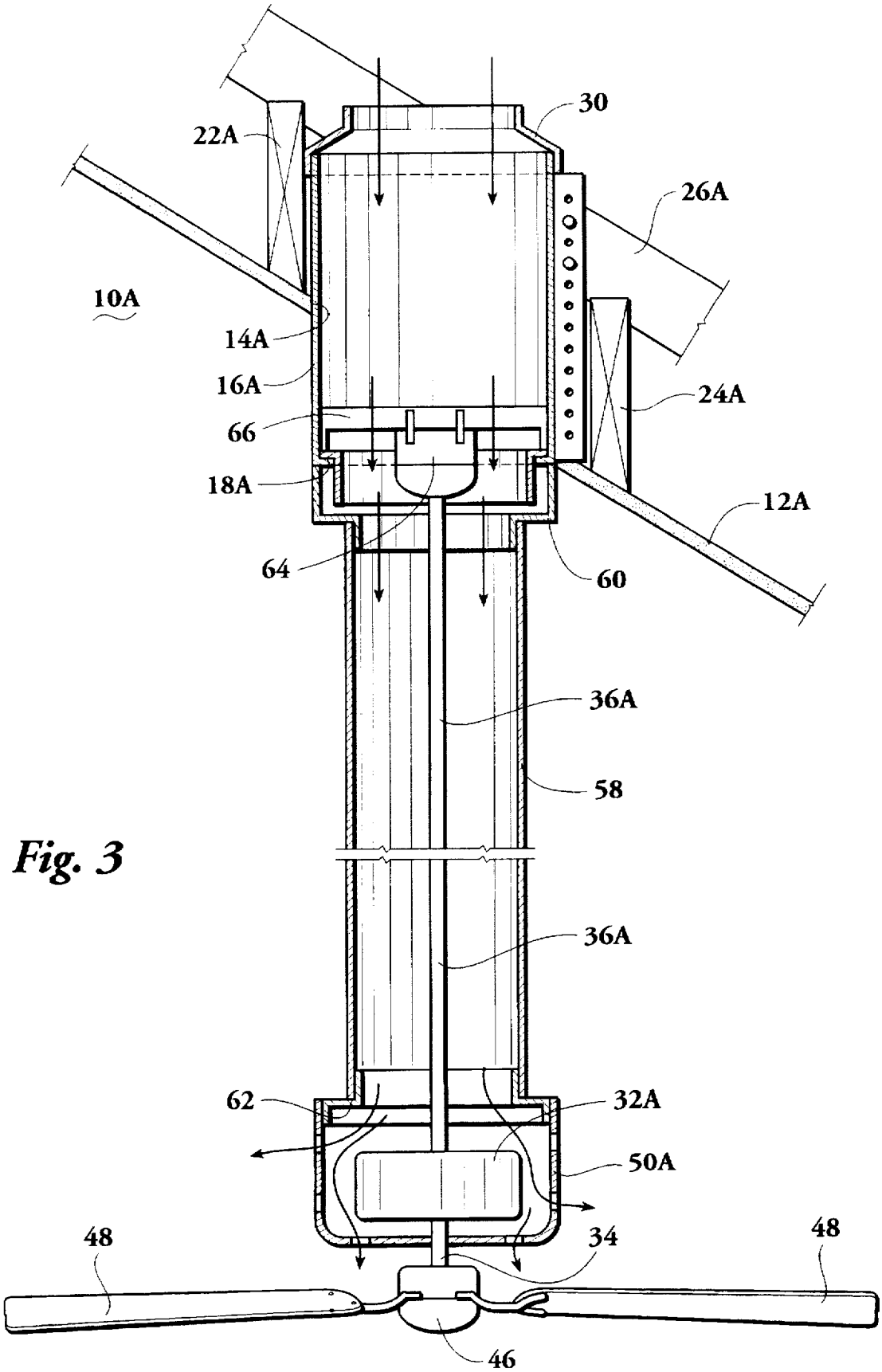
FIG. 3 is an elevational cross-sectional view of an alternate embodiment of this invention illustrating the method in which the system is employed in a room having an unusually high ceiling or a pitched ceiling. In this embodiment a plenum is in communication with an opening in the ceiling and with an elongated vertically extending tubular sleeve. An air diffuser is attached to the lower end of the tubular sleeve. A fan motor is supported within the diffuser.

Referring to FIG. 3 an alternate embodiment of the invention is shown for use in a room 10A that has a high ceiling or a pitched ceiling 12A. Rafters 22A and 24A support ceiling 12A and a cross member 26A is provided. A plenum 16A extends partially through the opening 14A in ceiling 12A and receives a boot adapter 30 as described with reference to FIG. 1. A forced air duct connects to boot adapter 30 but is not illustrated in FIG. 3.

To reduce the elevation of an air diffuser and a ceiling fan used in conjunction therewith, a vertically extending tubular sleeve 58 is employed, the upper end thereof being affixed to an adapter 60 that connects to the lower end 18A of plenum 16A. Tubular sleeve lower end 62 receives diffuser 50A that surrounds fan motor 32A, the fan motor being supported by an elongated motor mount 36A which is attached at its upper end to a motor mount support 64 which, in turn, is secured to a cross-bracket 66. Cross-bracket 66 is secured to the interior of plenum 16A. The arrangement of FIG. 3 includes a plenum 16A having more structural integrity than is required merely for the passage of air therethrough since it must support tubular sleeve 58, fan motor 32A and blades 48. The method of supporting fan motor 32A by means of motor mount 36A and motor mount support 64 is by example only as other means can be devised for supporting the weight of the motor, such as by physically securing the upper end of motor mount 36A to the building structural components, and therefore the specific structural arrangement for supporting the fan motor is not an integral part of this invention. What is important about the invention is the concept of integrating fan motor 32A and diffuser 50A for the plurality of functions as has been previously described to achieve improved esthetics, improved air distribution and economy.

Figure 5:
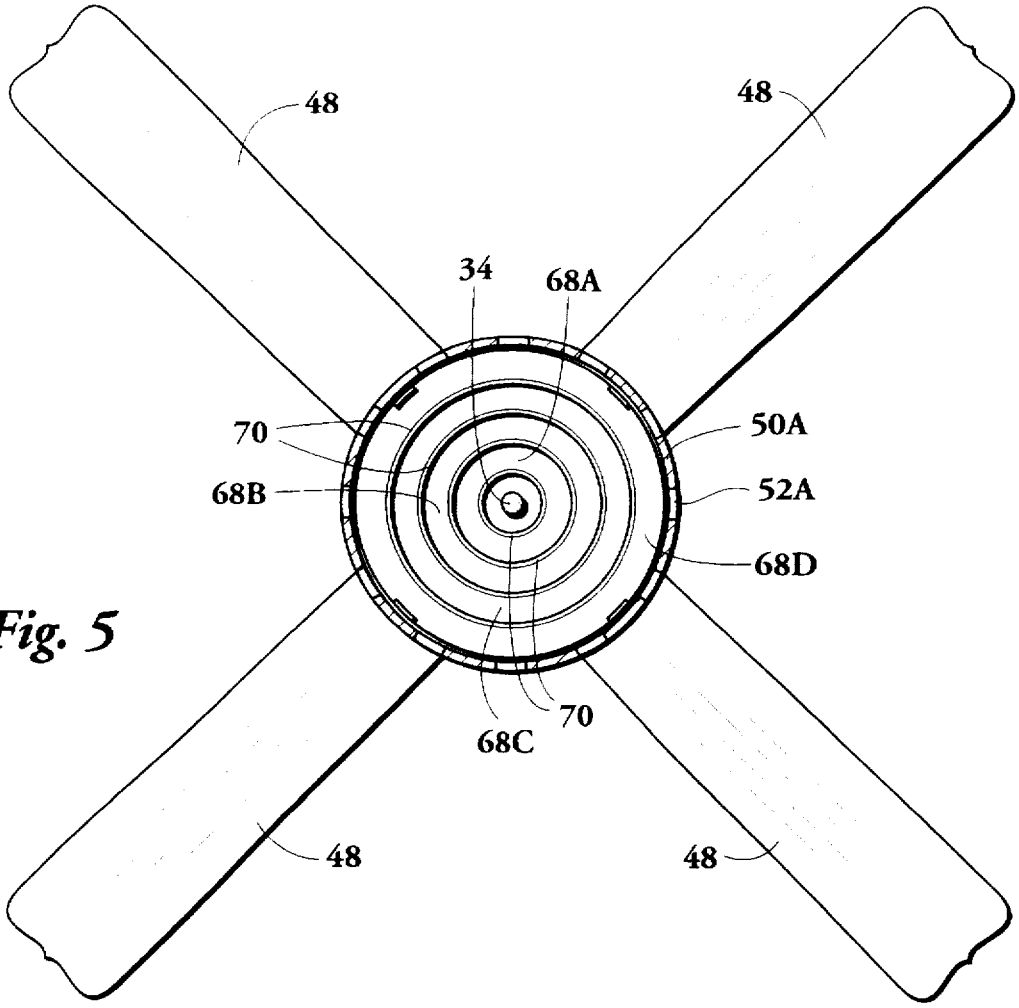
FIG. 5 is a horizontal cross-sectional view taken along the line 5—5 of FIG. 4.
Figure 4:
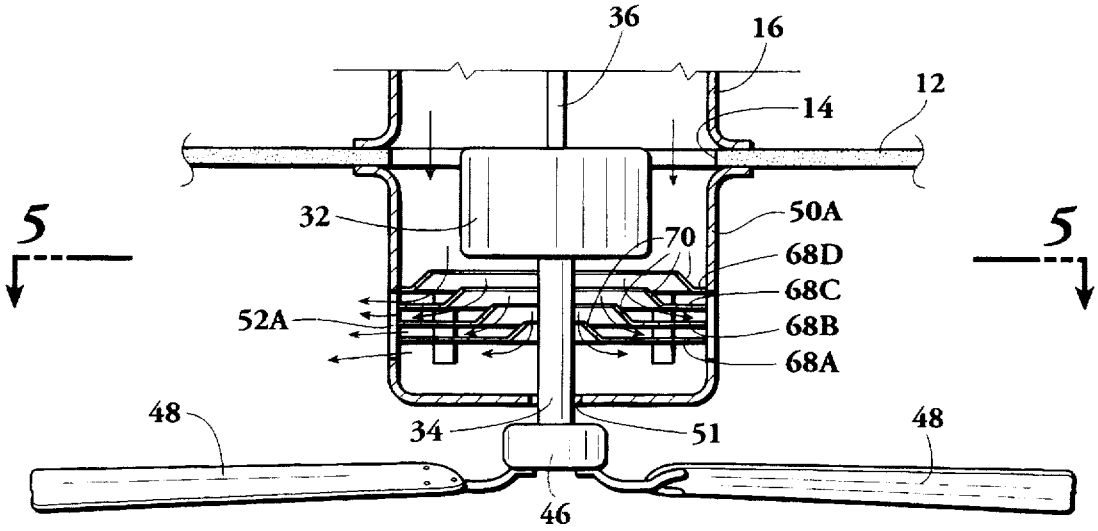
FIG. 4 shows an elevational cross-sectional view of another alternate embodiment of the invention, similar to the embodiment of FIG. 1, but wherein the air diffuser has internal baffles to more effectively horizontally distribute the air enumerating from the plenum.

Referring now to FIGS. 4 and 5 an additional embodiment of the invention is shown in which horizontal ceiling 12 has an opening 14 therein as previously detailed. Communicating with opening 14 is shown a fragmentary lower portion of a plenum 16. A fan motor 32 is supported within the interior of a diffuser 50A, the diffuser being secured to ceiling 12 in communication with opening 14. Motor 32 is supported by a motor mount 36 as was described with reference to FIGS. 1 and 2, the motor having a shaft 34 extending therefrom, the shaft extending out through an opening 51 in the bottom of diffuser 50A. Surrounding motor shaft 34 and within the interior of diffuser 50A are a plurality (four being shown) of air diverters 68A through 68D. Air diverters 68A through 68D are each generally positioned in a horizontal plane and each has a central opening therein that receives shaft 34. The portions of the air diverter adjacent the shaft are upwardly inclined at 70 to assist in moving air from a vertically downward direction into a horizontal component as illustrated by the arrows. Thus air diverters 68A–68D serve to cause a more radial distribution of air flowing out the diffuser 50A.

Another embodiment of the invention is illustrated in FIG. 6 which illustrates plenum 16B shaped differently than those of FIGS. 1 and 3. Plenum 16B is supported directly to ceiling joist 22B and 24B by flanges 72. Boot cap adapter 30A is shown to be integrally formed with plenum 16B. In this embodiment motor 32B is illustrated as being of the type wherein blades 48 are secured by blade brackets 74 directly to rotor 76. This system permits a tubular extension 78 which is non-rotatably secured to motor 32B to extend out through rotor 76 to which a housing 80 is attached. Housing 80 may be used to house switches such as for controlling the speed or direction of rotation of motor 32B, or housing 80 can be used to support a light fixture (not shown) so that a light may be combined with the air diffuser and ceiling fan. The use of lights with ceiling fans is well known, therefore the use of lights with the system of this invention is considered to be a part of the invention, it being understood that to the practitioner skilled in the art the use of a light fixture below a ceiling fan having a non-rotating extension 78 is a standard technique.

In the embodiment of FIG. 6 the motor mount 36A is secured to a bracket 82 which in turn is attached to a brace 84 that extends within plenum chamber 16B between ceiling joist 22B and 24B illustrating another way of supporting a motor within a diffuser.

In the embodiment of FIG. 6 the diffuser of 50A is shown to have triangular openings 52A in the upper portion and round openings 52B in the lower portion illustrating the fact that the esthetic arrangement of diffuser 50A can be changed considerably. Any diffuser that provides the combination of means for passing air under pressure out through the diffuser while housing a motor 52B is within the scope of the system of this invention.

In FIG. 6, an electrical junction box 86 is secured to the exterior of plenum chamber 16B, with a conduit 88 extending from junction box 86 to motor bracket 82 as a means of enclosing conductors (not seen) to supply electrical energy to motor 32B.

The system described herein attains all of the objectives as set forth in the summary of the invention and provides an improved system for installing a ceiling fan in combination with an air diffuser in a room to achieve a plurality of advantages, namely to achieve better distribution of air received from a forced draft system, to provide improved esthetics and economy.

FIG. 6 shows an air switch 90 mounted on plenum 16B, the switch having an elongated reed 92 extending out to a small target 94. Target 94 is held adjacent the center of plenum 16B to respond to the movement of air through the plenum. When air movement occurs, switch 90 is closed.

A typical circuit is illustrated in FIG. 12. One pole of motor 32B is connected to a conductor 96 that is typically a ground or neutral wire. Switch 90 is connected between motor 32B and a hot wire 98 in series with an on/off switch 100. When switch 100 is closed, motor 32B will be turned on when switch 90 detects flow of air through plenum 16B. Switch 100 can be mounted on housing 80 or can be wall mounted.

In parallel with switches 90 and 100 are switches 102 and 104. Switch 102 is a wall mounted on/off switch that is in series with motor 32B. On/off switch 104 is preferably located on housing 80 and is connected between switch 104 and hot wire 98, that is, switch 104 is in series with on/off wall mounted switch 102. When both switches 102 and 104 are closed motor 32B will be turned on whether or not air is flowing through plenum 16B.

The circuit works in the following fashion. When first wall switch 100 (preferably mounted on housing 80) is turned on, motor 32B will be energized when air movement is detected by air switch 90. This means that if the heating and air conditioning system is actuated and forced air is moving through duct 28 and thereby plenum 16B, the fan motor 32B will be actuated to distribute air that is being passed into the room. When air flow movement stops, then fan motor 32B is de-energized. In other words, with switch 100 turned on the system for distributing air in the room using the combination air diffuser/ceiling fan will operate the ceiling fan anytime that air is being moved into the room, whether for heating or for cooling, to improve the air distribution and the fan will automatically be turned off when no air is being moved into the room. On the other hand, if second wall switch 102 is turned on, fan motor 32B is energized if switch 104, preferably located on housing 80, is also turned on. Switch 102 is a wall switch and is only for easy accessibility for the occupants to turn the fan on. Switches 102 and 104 work independently from switches 90 and 100.

FIG. 7 shows an alternate embodiment of the arrangement of the air diffuser/ceiling fan combination of FIG. 6 by the inclusion of a generally conically shaped air deflector 106. This air deflector, which is shown isometrically in FIG. 8, is preferably formed of a thin material, either metal or plastic, and is generally conical shaped but in the illustrated and preferred embodiment, is provided with a sequence of tiers that reduce step wise in diameter. The air deflector 106 has an open bottom 108 and a smaller diameter opening 110 in the top that receives the motor mount 36A as seen in FIG. 6.

A function of air deflector 106 is to improve and streamline the air flow passing from plenum 16B through air diffuser 50A. Deflector 106 helps change the direction of air from a downward direction as it passes out of plenum 16B to a more radial and horizontal direction to be more effectively distributed by fan blades 48.

FIG. 9 shows an additional embodiment of the invention that, in addition to the inclusion of air deflector 106 includes provisions for regulating the volume of air passing out through the diffuser. In this embodiment diffuser 50A has a cylindrical sidewall 112 (seen best in FIG. 7) that has a plurality of openings 114 therein. Positioned within the interior of diffuser 50A is a short length tubular slip band 116 that is shown isometrically in FIG. 10. The slip band 116 is rotatable relative to diffuser sidewall 112 and the slip band has a plurality of spaced apart openings 118 therein. Extending from slip band 116, as seen in both FIGS. 9 and 10, are radial tabs 120 that move in slots (not seen) in the diffuser sidewall 112. Slip band 116 can thus be rotated to either align openings 118 with openings 114 in diffuser sidewall 112 or to mis-align such openings. In this way the volume of openings in the diffuser sidewall 112 is controllable to thereby control the amount of air discharged through the diffuser.

As shown in FIGS. 7 and 9, the diffuser sidewall further has a bottom portion defined by a frusto-conical sidewall 122 that has openings 124 therein. Rotatably supported within the diffuser lower portion and in contact with the internal frusto-conical surface of sidewall 122 is a frusto-conical shaped slip band 126 that has openings 128 therein. The frusto-conical slip band 126 and the openings therein are best seen in the isometric view of FIG. 11. Tabs 130 extend from frusto-conical slip band 126 and through slots (not seen) in the frusto-conical sidewall 122 so that slip band 126 may be positioned to align or dis-align the openings therein with the openings in the sidewall to control the amount of air discharged from diffuser 50A. Slip bands 116 and 126 could be formed as a single unit and as such would function in the same way to open or close openings in both the upper and lower portion of the diffuser sidewall. By the use of the slip bands, the quantity of air being discharged into a room as it flows from duct work 28 and plenum 16B into the room can be controlled by the room occupants.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A system for distributing air through a ceiling into a room, the ceiling being supported by structural members, the air being supplied by a duct located above the ceiling, comprising:

an elongated vertically oriented plenum having a top and an open bottom and being mounted for support and for communication with an air supply duct, the open bottom having flush communication with an opening in the ceiling;

an air diffuser positioned within a room in communication with said opening in the ceiling and with said plenum open bottom providing for passage of air from said plenum into the room, the air diffuser having a bottom with an opening therethrough;

a bracket secured and supported transversely within said plenum intermediate said plenum top and bottom, the bracket having opposed ends adaptable for supporting attachment to ceiling supporting structural members;

an electric motor supported to said bracket and within said air diffuser, the motor having a rotating portion in alignment with said opening in said air diffuser bottom; and a plurality of fan blades affixed to and extending radially and at least substantially horizontally from said motor rotating portion and below said diffuser.

2. A system for distributing air into a room according to claim 1 including:

a vertically extending elongated tubular sleeve having an open upper end and an open lower end, the upper end being secured in communication with said plenum open bottom, the sleeve extending downwardly into a room, said air diffuser being secured in communication with the sleeve open lower end.

3. A system for distributing air into a room according to claim 2 including an elongated vertical motor support received within said sleeve having a supported upper end portion and a lower end portion affixed to and supporting said motor.

4. A system for distributing air into a room according to claim 3 wherein said motor support is in the form of a tubular conduit providing a passageway for receiving conductors therein by which electrical energy is supplied to said motor.

5. A system for distributing air into a room according to claim 1 including:

a motor support extending from said bracket to said motor by which said motor is supported.

6. A system for distributing air into a room according to claim 5 including:

an electrical junction box affixed to said bracket within said plenum, said motor support having an upper end secured to the junction box and a lower end secured to said motor.

7. A system for distributing air into a room according to claim 6 wherein said motor support and said junction box provide a passageway for conductors extending to said motor.

8. A system for distributing air into a room according to claim 1 including:

a generally conically shaped air deflector positioned within said diffuser and above said motor and configured to distribute air flow out through the diffuser.

9. A system for distributing air into a room according to claim 1 wherein said diffuser has a cylindrical sidewall with a plurality of openings therein through which air is discharged and including a short length tubular slip band that fits rotatably within and coaxial with said sidewall, the tubular slip band having spaced apart openings therein that are in alignment with or out of alignment with said openings in said sidewall according to the rotatable position of the slip band whereby the slip band can be selectably rotatably positioned to control air flow volume out through said diffuser.

10. A system for distributing air into a room according to claim 1 wherein said diffuser has a vertical cylindrical sidewall that terminates at a lower end with a downwardly and inwardly tapered frusto-conical portion that has spaced apart openings therethrough through which air is discharged and including a short length frusto-conical slip band that fits rotatably within said diffuser frusto-conical portion, the frusto-conical slip band having spaced apart openings therein that are in alignment with or out of alignment with said openings in said diffuser frusto-conical portion according to the rotatable position of the slip band whereby the slip band can be selectably rotatably positioned to control air flow volume through said diffuser.

11. A system for distributing air into a room according to claim 1 including:

an air movement detector switch mounted with respect to said plenum that responds to close a circuit when air flows through said plenum, the air movement detector switch being connected in electrical series with said motor whereby said motor is energized when air flows through said plenum to ensure improved distribution of air in the room.

* * * * *